US005874925A

United States Patent [19]

Choi

[11] Patent Number: 5,874,925

[45] Date of Patent: Feb. 23, 1999

[54] PARABOLIC ANTENNA CAPABLE OF ADJUSTING THE ELEVATION ANGLE OF A FEED HORN

[75] Inventor: Yong-Hwan Choi, Seoul, Rep. of Korea

[73] Assignee: Daewoo Electronics Co., Ltd., Rep. of Korea

[21] Appl. No.: 748,582

[22] Filed: Nov. 13, 1996

[30] Foreign Application Priority Data

Nov. 13, 1995 [KR] Rep. of Korea ..... 1995 40949

[51] Int. Cl.[6] ..... H01Q 3/16

[52] U.S. Cl. ..... 343/840; 343/839; 343/761

[58] Field of Search ..... 343/840, 757, 343/758, 761, 762, 763, 766, 839, 786; H01Q 3/16, 19/12

[56] References Cited

U.S. PATENT DOCUMENTS 5,184,145 2/1993 Devillers et al. ..... 343/840

5,646,638 7/1997 Winegard et al. ..... 343/840

5,696,519 12/1997 Suzuki et al. ..... 343/840

5,714,960 2/1998 Choi ..... 343/840

*Primary Examiner*—Hoanganh Le

*Attorney, Agent, or Firm*—Pennie & Edmonds LLP

[57] ABSTRACT

A parabolic antenna provided with a reflector and an arm comprises a housing fixed to a free end of the arm, a case enclosing a low noise blockdown converter ("LNB"), a feed horn protruding from a front side of the LNB case and a driving and a driven gears for adjusting an elevation angle of the feed horn. The LNB case has a pair of hinge pins. The housing has a pair of supporting members which are spaced from each other and provided with a pair of apertures into which the hinge pins of the LNB case are snugly fitted, respectively. The driven gear is engaged on one of the hinge pins of the LNB case and the driving gear is engaged on an input shaft. The input shaft rotatably passes through one of the supporting members, the driving gear and the driven gear being meshed with each other and, in turn, rotated with the input shaft, thereby allowing the elevation angle of the feed horn can be adjusted by rotating the input shaft.

12 Claims, 5 Drawing Sheets

PARABOLIC ANTENNA CAPABLE OF ADJUSTING THE ELEVATION ANGLE OF A FEED HORN

FIELD OF THE INVENTION

The present invention relates to a parabolic antenna; and, more particularly, to a parabolic antenna which allows the elevation angle of a feed horn incorporated therein to be adjusted with ease.

DESCRIPTION OF THE PRIOR ART

There is shown in FIG. 1 a schematic view of a conventional parabolic antenna disclosed in U.S. Pat. No. 4,819,007. The conventional parabolic antenna includes a paraboloidal reflector 3, a case 9 enclosing a low noise blockdown converter ("LNB"), a feed horn 4 protruding from the front side of the LNB case 9, a frame 5 and an arm 6.

The frame 5 is fixed on the rear side of the reflector 3 at one end by using bolts. The arm 6 is connected to the other end of the frame 5 at one end through a pair of gussets 7 bolted to the frame 5 and the arm 6. The LNB case 9 with the feed horn 4 is fixed to the other free end of the arm 6 through a support plate 8. In this way, the feed horn 4 comes to be positioned at a focal point of the reflector 3.

However, in such a conventional parabolic antenna, since the LNB case is fixed to the free end of the arm, making it difficult to adjust the elevation angle of the feed horn therein, a precise positioning of the feed horn at the focal point of the reflector becomes difficult.

SUMMARY OF THE INVENTION

It is, therefore, a primary object of the invention to provide a parabolic antenna which allows the elevation angle of a feed horn to be adjusted with ease, thereby facilitating a precise positioning of the feed horn at the focal point of a reflector.

In accordance with an aspect of the present invention, there is provided a parabolic antenna provided with a reflector and an arm, which comprises: a housing fixed to a free end of the arm; a case enclosing an LNB, the LNB case being rotatably supported by the housing; a feed horn protruding from a front side of the LNB case; and a means for adjusting an elevation angle of the feed horn.

In accordance with another aspect of the present invention, there is provided a parabolic antenna provided with a reflector and an arm, which comprises: a case enclosing an LNB, the LNB case being rotatably supported to a free end of the arm; a feed horn protruding from a front side of the LNB case; and means for adjusting an elevation angle of the feed horn.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
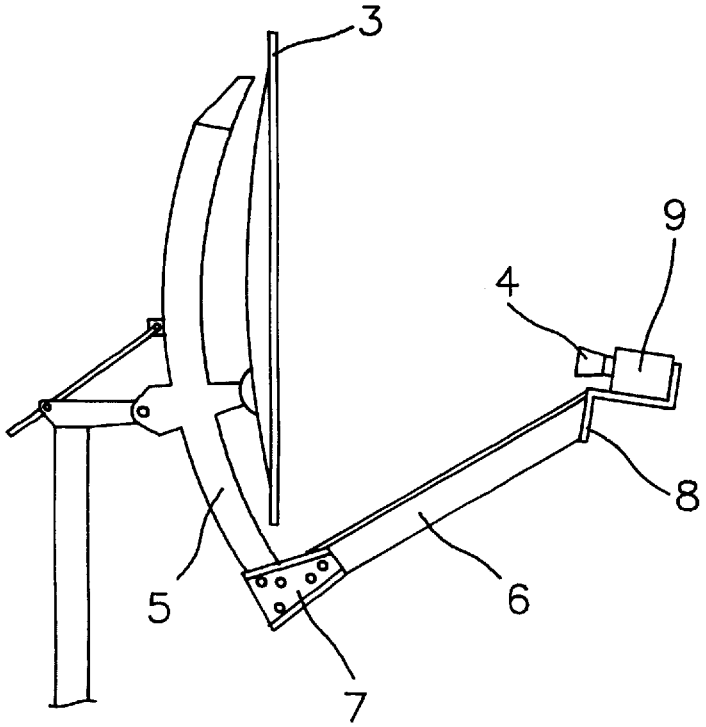
FIG. 1 (PRIOR ART)
FIG. 1 represents a schematic view of a conventional parabolic antenna.

Although the main aspect of a parabolic antenna in accordance with the present invention is shown in FIGS. 2 to 5, FIG. 1 will also be referenced in describing the inventive parabolic antenna. Furthermore, like reference numerals in the drawings represent same components.

Figure 2:
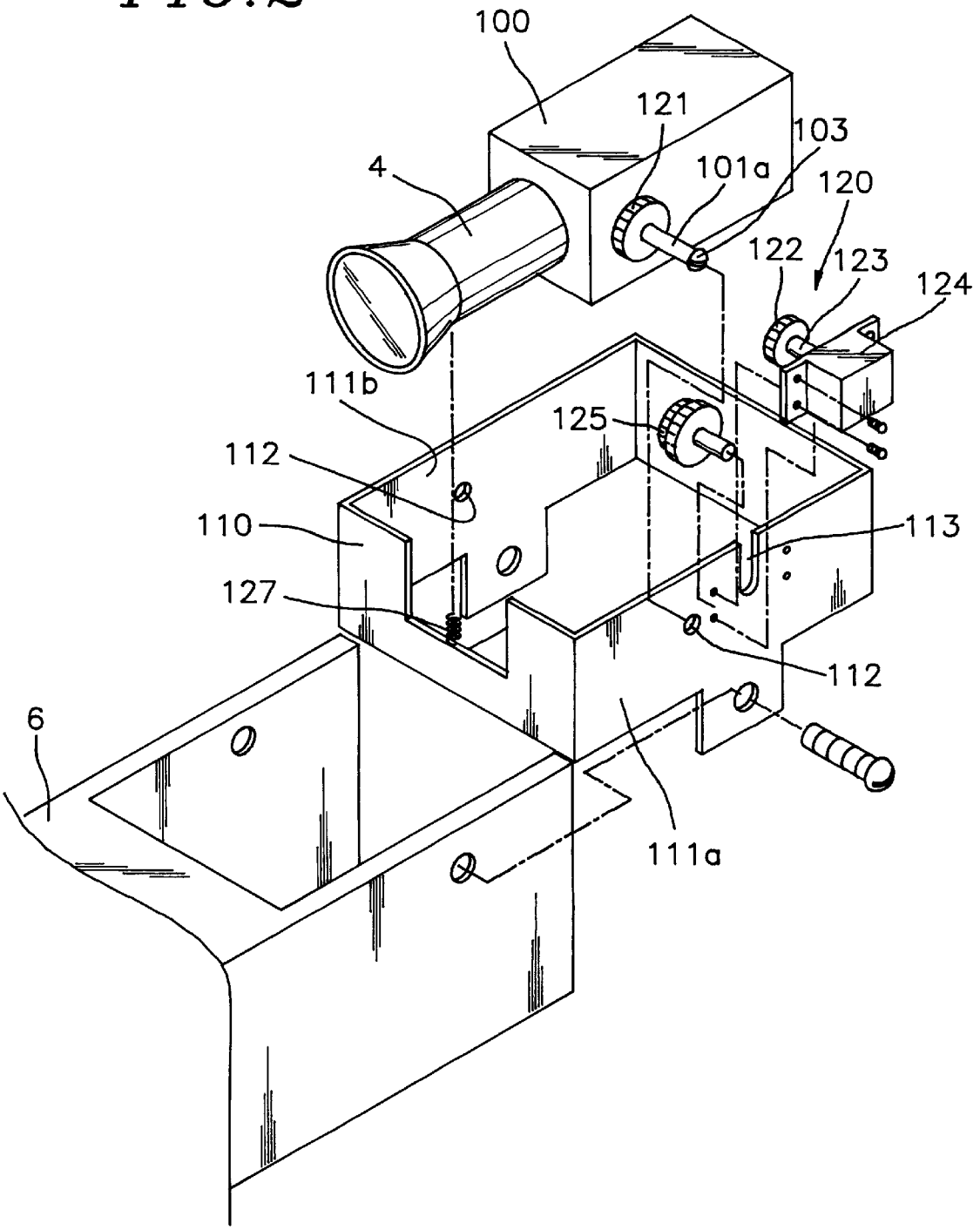
FIG. 2 depicts an exploded perspective view of a parabolic antenna in accordance with a preferred embodiment of the present invention, mainly showing the housing and the means for adjusting the elevation angle of the feed horn.
Figure 3:
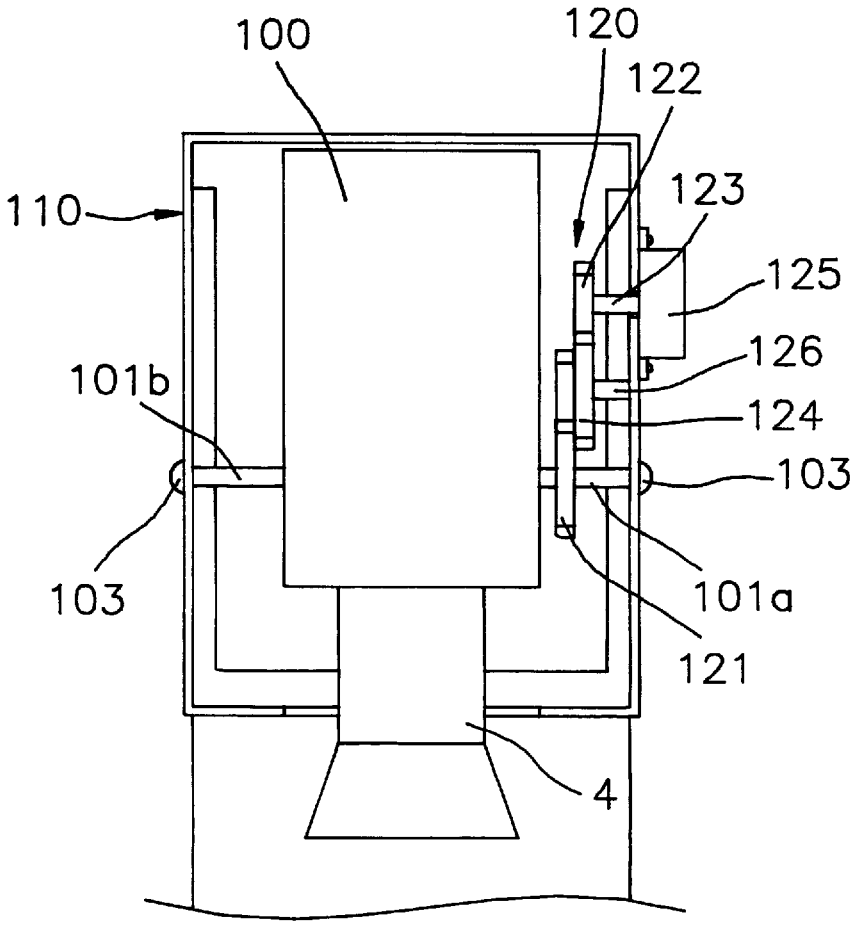
FIG. 3 sets forth a front view of the parabolic antenna in FIG. 2.

Referring to FIGS. 1 to 3, a parabolic antenna in accordance with a preferred embodiment of the present invention includes a paraboloidal reflector 3, a case 100 enclosing a low noise blockdown converter ("LNB"), the LNB case 100 having a pair of hinge pins 101 coaxially outwardly protruding from both sides thereof, a feed horn 4 protruding from a front side of the LNB case 100 and positioned at a focal point of the reflector 3, an arm 6, a housing 110 for rotatably supporting the LNB case 100 and a means 120 for adjusting the elevation angle of the feed horn 4.

The frame 5 is fixed on the rear side of the reflector 3 at one end by using bolts. The arm 6 is connected to the other end of the frame 5 at one end through a pair of gussets 7 bolted to the frame 5 and the arm 6.

As shown in detail in FIGS. 2 and 3, the housing 110 is fixed to the free end of the arm 6, having a pair of supporting members 111*a*, 111*b* spaced apart from each other to receive the LNB case 100 therebetween. The supporting members 111*a*, 111*b* are provided with a pair of apertures 112 into which the hinge pins 101*a*, 101*b* of the LNB case 100 are snugly fitted, respectively, thereby rotatably supporting the LNB case 100. The elevation angle adjusting means 120 includes a driven gear 121 engaged on the hinge pin 101*a*, a driving gear 122 engaged on an input shaft 123 rotated by an appropriate means, e.g., motor 124 and a reduction gear 125 rotatably coupled on a supporting shaft 126. The motor 124 is attached to the supporting member 111*a* in such a way that the input shaft 123 rotatably passes through the supporting member 111*a*. The supporting shaft 126 is fixed to the supporting member 111*a* in such a way that the reduction gear 125 is disposed between and meshed with the driving and the driven gears 122, 121. The driving and the driven gears 122, 121 may directly be meshed with each other without the reduction gear 125. The input shaft 123 is selectively rotated depending on the activation of the motor 124 and the gears 122, 125 and 121 are, in turn, rotated, thereby rotating the LNB case 100. Therefore, if desired, the elevation angle of the feed horn 4 can be adjusted by rotating the input shaft 123.

The supporting member 111*a* is further provided with an open slot 113 extending vertically, to thereby facilitate the attachment of the motor 124 and the input shaft 123 to the supporting member 111*a* by the input shaft 123 moving down along the open slot 113. Each of the hinge pins 101*a*, 101*b* is provided with an elastic hook 103 at its end, thereby preventing the LNB case 100 from moving from side to side. Furthermore, in order to prevent an up and down movement of the feed horn 4 due to the backlash between the gears, a tensile spring 127 is disposed such that both ends thereof are connected to the housing 110 and the feed horn 4, thereby biasing the feed horn 4 downwardly.

Figure 4:
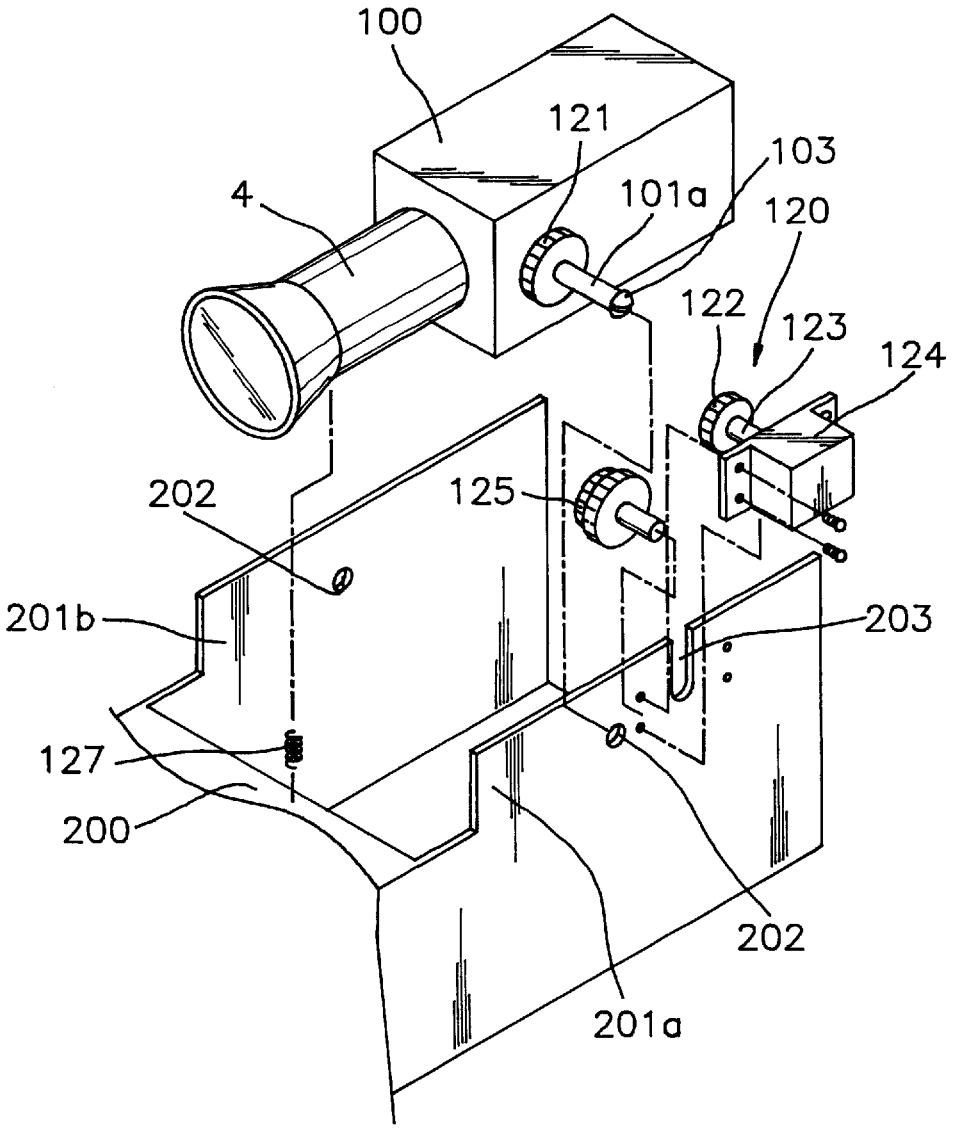
FIG. 4 presents an exploded perspective view of a parabolic antenna in accordance with another preferred embodiment of the present invention, mainly showing the housing and the means for adjusting the elevation angle of the feed horn.
Figure 5:
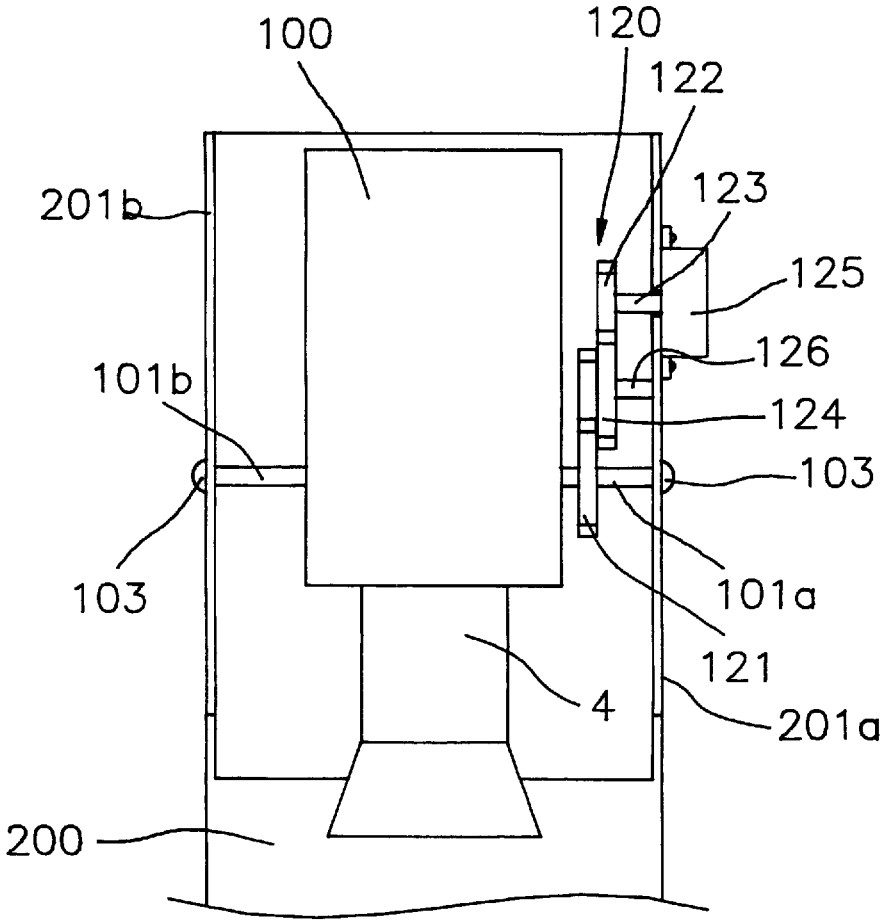
FIG. 5 sets forth a front view of the parabolic antenna in FIG. 4.

There is shown in FIGS. 4 and 5 another preferred embodiment of the present invention. The second preferred embodiment is similar to the first except that the LNB case 100 is directly fixed to the free end of an arm 200 without the housing 110.

In the parabolic antenna of the second preferred embodiment, the arm 200 has a pair of protruding portions 201*a*, 201*b* spaced apart from each other to receive the LNB case 100 therebetween. The protruding portions 201*a*, 201*b* are provided with a pair of holes 202 into which the hinge pins 101*a*, 101*b* of the LNB case 100 are snugly fitted, respectively, thereby rotatably supporting the LNB case 100. The protruding portion 201*a* is further provided with an open slot 203. The motor 124 is attached to the protruding portion 201*a* in such a way that the input shaft 123 rotatably passes therethrough. The supporting shaft 126 is fixed to the protruding portion 201*a* in such a way that the reduction gear 125 is disposed between and meshed with the driving and the driven gears 122, 121. The protruding portion 201*a* is further provided with an open slot 203 extending vertically to thereby facilitate the attachment of the motor 124 and the input shaft 123 thereto by the input shaft 123 moving down along the open slot 203. The tensile spring 127 is disposed such that both ends thereof are connected to the arm 200 and the feed horn 4, thereby biasing the feed horn 4 downwardly.

According to the present invention, the elevation angle of the feed horn can be adjusted with ease, thereby facilitating the precise positioning of the feed horn at the focal point of the reflector.

Although the invention has been shown and described with respect to the preferred embodiments, it will be understood by those skilled in the art that various changes and modifications may be made without departing from the spirit and scope of the invention as defined in the following claims.

What is claimed is:

1. A parabolic antenna provided with a reflector and an arm, which comprises:

a housing fixed to a free end of the arm;

a case enclosing a low noise blockdown converter ("LNB"), the LNB case being rotatably supported by the housing;

a feed horn protruding from a front side of the LNB case; and means for adjusting an elevation angle of the feed horn, wherein the LNB case has a pair of hinge pins; the housing has a pair of supporting members for rotatably supporting the LNB case, the supporting members being spaced from each other and provided with a pair of apertures into which the hinge pins of the LNB case are snugly fitted, respectively; and the elevation angle adjusting means includes a driven gear engaged on an input shaft, the input shaft rotatably passing through one of the supporting members, the driving gear and the driven gear being meshed with each other and, in turn, rotated by rotating the input shaft.

2. The parabolic antenna of claim 1, wherein the elevation angle adjusting means further includes a reduction gear disposed between and meshed with the driving and the driven gears.

3. The parabolic antenna of claim 1, wherein each of the hinge pins is provided with an elastic hook at its end for preventing the LNB case from moving from side to side.

4. The parabolic antenna of claim 1, wherein the elevation angle adjusting means further includes a tensile spring both ends of which are connected to the housing and the feed horn, respectively, thereby biasing the feed horn downwardly.

5. A parabolic antenna provided with a reflector and an arm, which comprises:

a case enclosing a low noise blockdown converter ("LNB"), the LNB case being rotatably supported to a free end of the arm;

a feed horn protruding from a front side of the LNB case; and means for adjusting an elevation angle of the feed horn, wherein the LNB case has a pair of hinge pins; the arm has a pair of protruding portions for rotatable supporting the LNB case, the protruding portions being spaced from each other and provided with a pair of holes in which the hinge pins of the LNB case are snugly fitted, respectively; and the elevation angle adjusting means includes a driven gear engaged on one of the hinge pins and a driving gear engaged on an input shaft, the input shaft rotatably passing through one of the protruding portion of the arm, the driving and the driven gears being meshed with each other and, in turn, rotated by rotating the input shaft.

6. The parabolic antenna of claim 5, wherein the elevation angle adjusting means further includes a reduction gear disposed between and meshed with the driving and the driven gears.

7. The parabolic antenna of claim 5, wherein each of the hinge pins is provided with a hook at its end for preventing the LNB case from moving from side to side.

8. The parabolic antenna of claim 5, wherein the elevation angle adjusting means further includes a tensile spring both ends of which are connected to the arm and the feed horn, respectively, thereby biasing the feed horn downwardly.

9. A parabolic antenna comprising:

a reflector connected to a first end of an arm;

a case enclosing a low noise blockdown converter ("LNB"), said LNB case being rotatably connected to a second end of the arm;

a feed horn protruding from a front side of the LNB case;

a motor disposed proximate to the second end of the arm; and a gear mechanism operatively connecting the motor to the LNB case to transmit the output from said motor to rotate the LNB case to alter an elevation angle of the LNB case with respect to the reflector.

10. The parabolic antenna as set forth in claim 9 further comprises a housing member connected to the second end of the arm and adapted to rotatably support the LNB case.

11. The parabolic antenna as set forth in claim 9, wherein the LNB case has at least one hinge pin sized and configured to be received by at least one corresponding aperture disposed proximate to the second end of the arm, such that the LNB case is rotatably supported on the arm.

12. The parabolic antenna as set forth in claim 11, wherein the gear mechanism includes a driven gear disposed on the hinge pin, and a driving gear disposed on an input shaft, said motor, said driving and the driven gears being meshed with each other and are rotated by rotating the input shaft.

* * * * *